United States Patent [19]

Miskinis et al.

[11] Patent Number: 4,546,060

[45] Date of Patent: Oct. 8, 1985

[54] TWO-COMPONENT, DRY ELECTROGRAPHIC DEVELOPER COMPOSITIONS CONTAINING HARD MAGNETIC CARRIER PARTICLES AND METHOD FOR USING THE SAME

[75] Inventors: Edward T. Miskinis; Thomas A. Jadwin, both of Rochester, N.Y.

[73] Assignee: Eastman Kodak Company, Rochester, N.Y.

[21] Appl. No.: 548,807

[22] Filed: Nov. 4, 1983

[51] Int. Cl.[4] ..... G03G 9/14

[52] U.S. Cl. ..... 430/108; 430/106.6; 118/657; 148/108

[58] Field of Search ..... 430/106.6, 107, 108, 430/122; 118/657; 148/108

[56] References Cited

U.S. PATENT DOCUMENTS

| | | | |
|---|---|---|---|
| 3,947,370 | 3/1976 | Miller | 430/106.6 |
| 3,996,492 | 12/1976 | Berg et al. | 427/19 |
| 4,042,518 | 8/1977 | Jones | 430/108 |
| 4,124,385 | 11/1978 | O'Horo | 430/106.6 |
| 4,235,194 | 11/1980 | Wada et al. | 118/657 |
| 4,238,558 | 12/1980 | Ziolo | 430/108 |
| 4,239,845 | 12/1980 | Tanaka et al. | 430/122 |
| 4,242,434 | 12/1980 | Hirakura et al. | 430/122 |
| 4,277,552 | 7/1981 | Asanae et al. | 430/122 |
| 4,282,302 | 8/1981 | Makino et al. | 430/107 |
| 4,345,014 | 8/1982 | Oka et al. | 430/122 |
| 4,349,270 | 9/1982 | Wada et al. | 355/15 |

FOREIGN PATENT DOCUMENTS

| | | | |
|---|---|---|---|
| 30743 | 3/1976 | Japan | 430/107 |
| 123623 | 10/1977 | Japan . | |
| 55-12977 | of 1980 | Japan . | |
| 0028020 | 2/1980 | Japan | 430/106.6 |
| 16145 | 2/1981 | Japan | 430/106.6 |
| 177161 | 10/1982 | Japan | 430/108 |
| 1386964 | 3/1975 | United Kingdom . | |
| 2075209A | 11/1981 | United Kingdom . | |

*Primary Examiner*—John D. Welsh
*Attorney, Agent, or Firm*—David F. Janci

[57] ABSTRACT

An electrographic, two-component dry developer composition comprising charged toner particles and oppositely charged, magnetic carrier particles, which (a) comprise a magnetic material exhibiting "hard" magnetic properties, as characterized by a coercivity of at least 300 gauss and (b) exhibit an induced magnetic moment of at least 20 EMU/gm when in an applied field of 1000 gauss, is disclosed.

The developer is employed in combination with a magnetic applicator comprising a rotatable magnetic core and an outer, nonmagnetizable shell to develop electrostatic images.

43 Claims, 2 Drawing Figures

TWO-COMPONENT, DRY ELECTROGRAPHIC DEVELOPER COMPOSITIONS CONTAINING HARD MAGNETIC CARRIER PARTICLES AND METHOD FOR USING THE SAME

The invention herein relates to the field of electrography and to the development of electrostatic images. More particularly, the present invention relates to novel electrographic developer compositions and components thereof, and to a method for applying such compositions to electrostatic images to effect development thereof.

In electrography, an electrostatic charge image is formed on a dielectric surface, typically the surface of a photoconductive recording element. Development of this image is commonly achieved by contacting it with a two-component developer comprising a mixture of pigmented resinous particles (known as "toner") and magnetically attractable particles (known as "carrier"). The carrier particles serve as sites against which the nonmagnetic toner particles can impinge and thereby acquire a triboelectric charge opposite that of the electrostatic image. During contact between the electrostatic image and the developer mixture, the toner particles are stripped from the carrier particles to which they had formerly adhered (via triboelectric forces) by the relatively strong electrostatic forces associated with the charge image. In this manner, the toner particles are deposited on the electrostatic image to render it visible.

It is known in the art to apply developer compositions of the above type to electrostatic images by means of a magnetic applicator which comprises a cylindrical sleeve of nonmagnetic material having a magnetic core positioned within. The core usually comprises a plurality of parallel magnetic strips which are arranged around the core surface to present alternative north-/south magnetic fields. These fields project radially, through the sleeve, and serve to attract the developer composition to the sleeves outer surface to form a brush nap. Either or both the cylindrical sleeve and the magnetic core are rotated with respect to each other to cause the developer to advance from a supply sump to a position in which it contacts the electrostatic image to be developed. After development, the toner-depleted carrier particles are returned to the sump for toner replenishment.

U.S. Pat. No. 4,345,014 discloses a magnetic brush development apparatus which utilizes a two-component developer of the type described. The magnetic applicator is of the type in which the multiple pole magnetic core rotates to effect movement of the developer to a development zone. The magnetic carrier disclosed in this patent is of the conventional variety in that it comprises relatively "soft" magnetic material (e.g., magnetite, pure iron, ferrite or a form of $Fe_3O_4$) having a magnetic coercivity, Hc, of about 100 gauss or less. Such soft magnetic materials have been preferred heretofore because they inherently exhibit a low magnetic remanance, $B_R$, (e.g., less than about 5 EMU/gm) and a high induced magnetic moment in the field applied by the brush core. Having a low magnetic remanence, soft magnetic carrier particles retain only a small amount of the magnetic moment induced by a magnetic field after being removed from such field; thus, they easily intermix and replenish with toner particles after being used for development. Having a relatively high magnetic moment when attracted by the brush core, such materials are readily transported by the rotating brush and are prevented from being picked up by the recording element during development.

While the magnetic carrier materials disclosed in the above-identified patent and other similar magnetic carriers are useful in the development of images on recording elements moving at moderate velocities of, say, less than about 10 cm/sec, we have found that the development image quality rapidly deteriorates as the recording-element velocity increases. In fact, at a recording-element velocity of about 40 cm/sec, development with such carriers is virtually nonexistent, indicating that the carriers are incapable of delivering toner to the photoreceptor at high rates.

It is an object of the present invention, therefore, to provide an electrographic developer which, when used with a rotating-core magnetic applicator, exhibits development rates suitable for high-volume copying applications without loss of image quality. This object is accomplished with an electrographic, two-component dry developer composition comprising charged toner particles and oppositely charged carrier particles which (a) comprise a hard magnetic material exhibiting a coercivity of at least 300 gauss when magnetically saturated and (b) exhibit an induced magnetic moment of at least 20 EMU/gm when in an applied magnetic field of 1000 gauss.

In the method of the present invention, the above developer is employed in combination with a rotating-core magnetic applicator to develop electrostatic images. The method comprises contacting an electrostatic image with at least one magnetic brush comprising (a) a rotating magnetic core of a preselected magnetic-field strength, (b) an outer nonmagnetic shell and (c) an electrographic two-component dry developer composition comprising charged toner particles and oppositely charged, magnetic carrier particles which (a) comprise a hard magnetic material exhibiting a coercivity of at least 300 gauss when magnetically saturated and (b) exhibit an induced magnetic moment of at least 20 EMU/gm when in an applied magnetic field of 1000 gauss and which magnetic moment is sufficient to prevent said carrier from transferring to said electrostatic image.

In the ensuing discussion, reference will be made to the accompanying drawings in which.

In the practice of the method of the present invention, a rotating-core magnetic applicator for the developer is employed. Such applicators are well-known, as shown, for example, in U.S. Pat. Nos. 4,235,194 issued Nov. 25, 1980, to K. Wada et al, 4,239,845 issued Dec. 16, 1980, to S. Tanaka et al and 3,552,355 issued Jan. 5, 1971, to T. J. Flint.

Figure 1:
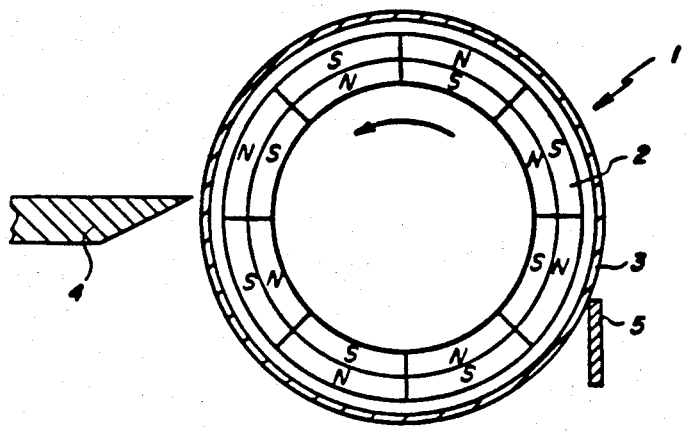
FIG. 1 shows a cross-sectional view of a magnetic applicator having a rotating magnetic core and an outer shell for use with the two-component dry developer of the present invention.

Referring to FIG. 1, a rotating-core magnetic applicator 1 comprises a core-shell arrangement composed of a multipolar magnetic core 2 rotatably housed within an outer shell 3. Shell 3 is composed of a nonmagnetizable material which serves as the carrying surface for the developer composition described below. Trim skive 4 is provided to regulate the thickness of the developer layer (nap thickness) on shell 3 during core 2 rotation.

Cutting skive 5 removes all developer from shell 3 after developer has passed through the development region.

The multipolar magnetic core 2 comprises a circumferential array of magnets disposed in a north-south-north-south polar configuraton facing radially outward. As the core rotates, the field from each pole travels circumferentially around the outer surface of the shell. The two-component developer of the present invention interacts with these moving fields to cause a turbulent, rapid flow of developer, as will become evident below in the discussion relative to the carrier.

The behavior of the carrier particles employed in the developer and method of the present invention is unique. When magnetic carrier particles which (a) contain magnetic material exhibiting a coercivity of at least 300 gauss and (b) have an induced magnetic moment of at least 20 EMU/gm when in an external magnetic field of 1000 gauss are employed, exposure to a succession of magnetic fields emanating from the rotating core applicator causes the particles to flip or turn to move into magnetic alignment in each new field. Each flip, moreover, as a consequence of both the magnetic moment of the particles and the coercivity of the magnetic material, is accompanied by a rapid circumferential step by each particle in a direction opposite the movement of the rotating core. The observed result is that the developers of the invention flow smoothly and at a rapid rate around the shell while the core rotates in the opposite direction, thus rapidly delivering fresh toner to the photoreceptor and facilitating high-volume copy applications.

The magnetic core of the applicator is made up of any one or more of a variety of well-known permanently magnetized magnetic materials. Representative magnetic materials include gamma ferric oxide, and "hard" ferrites as disclosed in U.S. Pat. No. 4,042,518 issued Aug. 16, 1977, to L. O. Jones.

The strength of the core magnetic field can vary widely, but a strength of at least 450 gauss, as measured at the surface of the core with a Hall-effect probe, is preferred and a strength of from about 800 to 1600 gauss is most preferred.

In general, the core size will be determined by the size of the magnets used, and the magnet size is selected in accordance with the desired magnetic-field strength. A useful number of magnetic poles for a 5-cm diameter core is from 8 to 24 with a preferred number from 12 to 20; however, this parameter will depend on the core size and rotation rate. Preferably, the shell-to-photoconductor spacing is relatively close, e.g., in the range from about 0.03 cm to about 0.09 cm, so as to provide sufficient brush engagement with the photoconductor.

The speed of rotation of the magnetic core can vary but preferably is between 1000 and 3000 revolutions per minute (rpm). The selection of an appropriate speed will depend on a variety of factors such as the outside diameter of the applicator shell, the size of the carrier particles and the desired rate of development as reflected by the linear speed at which photoconductive elements carrying charge images pass through the developer station.

The shell surrounding the core is composed of any suitable nonmagnetic material which acts as a development electrode for the process, such as a nonmagnetic stainless steel.

It is highly desirable (from the viewpoint of attaining preferred minimum development levels) to subject each portion of a photoconductive element passing through the development zone to at least 5 pole transitions within the active development region, as disclosed in copending U.S. patent application Ser. No. 519,476 filed Aug. 1, 1983, entitled "ELECTROGRAPHIC APPARATUS, METHOD AND SYSTEM EMPLOYING IMAGE DEVELOPMENT ADJUSTMENT."

While it is essential to the practice of the method of the present invention that the magnetic core be rotated during use, the shell may or may not also rotate. If the shell does rotate, it can do so either in the same direction as or in a different direction from the core.

As previously noted, the present invention provides a two-component, dry electrographic developer composition comprising charged carrier particles exhibiting specified magnetic properties and oppositely charged toner particles. When employed in combination with the rotating magnetic core applicator, the defined two-component developer exhibits a high rate of flow, and thus provides for complete development of an electrostatic image at high-volume copying rates, as defined below.

The novel developers of the present invention comprise two alternative preferred types of carrier particles. The first of these carriers comprises a binder-free magnetic particulate material exhibiting the requisite coercivity and induced magnetic moment.

In the second developer, each carrier particle is heterogeneous and comprises a composite of a binder and a magnetic material exhibiting the requisite coercivity and induced magnetic moment. The magnetic material is dispersed as discrete smaller particles throughout the binder; that is, each composite carrier particle comprises a discontinuous, particulate magnetic material phase of the requisite coercivity in a continuous binder phase.

The individual bits of the magnetic material should preferably be of a relatively uniform size and sufficiently smaller in diameter than the composite carrier particle to be produced. Typically, the average diameter of the magnetic material should be no more than about 20 percent of the average diameter of the carrier particle. Advantageously, a much lower ratio of average diameter of magnetic component to carrier can be used. Excellent results are obtained with magnetic powders of the order of 5 micrometers down to 0.05 micrometer average diameter. Even finer powders can be used when the degree of subdivision does not produce unwanted modifications in the magnetic properties and the amount and character of the selected binder produce satisfactory strength, together with other desirable mechanical properties in the resulting carrier particle.

The concentration of the magnetic material can vary widely. Proportions of finely divided magnetic material, from about 20 percent by weight to about 90 percent by weight, of composite carrier can be used.

The induced moment of composite carriers in a 1000-gauss applied field is dependent on the concentration of magnetic material in the particle. It will be appreciated, therefore, that the induced moment of the magnetic material should be sufficiently greater than 20 EMU/gm to compensate for the effect upon such induced moment from dilution of the magnetic material in the binder. For example, one might find that, for a concentration of 50 weight percent magnetic material in the composite particles, the 1000-gauss induced magnetic moment of the magnetic material should be at least 40 EMU/gm to achieve the minimum level of 20 EMU/gm for the composite particles.

The binder material used with the finely divided magnetic material is selected to provide the required mechanical and electrical properties. It should (1) adhere well to the magnetic material, (2) facilitate formation of strong, smooth-surfaced particles and (3) preferably possess sufficient difference in triboelectric properties from the toner particles with which it will be used to insure the proper polarity and magnitude of electrostatic charge between the toner and carrier when the two are mixed.

The matrix can be organic, or inorganic, such as a matrix composed of glass, metal, silicone resin or the like. Preferably, an organic material is used such as a natural or synthetic polymeric resin or a mixture of such resins having appropriate mechanical properties. Appropriate monomers (which can be used to prepare resins for this use) include, for example, vinyl monomers such as alkyl acrylates and methacrylates, styrene and substituted styrenes, basic monomers such as vinyl pyridines, etc. Copolymers prepared with these and other vinyl monomers such as acidic monomers, e.g., acrylic or methacrylic acid, can be used. Such copolymers can advantageously contain small amounts of polyfunctional monomers such as divinylbenzene, glycol dimethacrylate, triallyl citrate and the like. Condensation polymers such as polyesters, polyamides or polycarbonates can also be employed.

Preparation of composite carrier particles according to this invention may involve the application of heat to soften thermoplastic material or to harden thermosetting material; evaporative drying to remove liquid vehicle; the use of pressure, or of heat and pressure, in molding, casting, extruding, etc., and in cutting or shearing to shape the carrier particles; grinding, e.g., in a ball mill to reduce carrier material to appropriate particle size; and sifting operations to classify the particles.

According to one preparation technique, the powdered magnetic material is dispersed in a dope or solution of the binder resin. The solvent may then be evaporated and the resulting solid mass subdivided by grinding and screening to produce carrier particles of appropriate size.

According to another technique, emulsion or suspension polymerization is used to produce uniform carrier particles of excellent smoothness and useful life.

The coercivity of a magnetic material refers to the minimum external magnetic force necessary to reduce the remanance, Br, to zero while it is held stationary in the external field, and after the material has been magnetically saturated, i.e., the material has been permanently magnetized. A variety of apparatus and methods for the measurement of coercivity of the present carrier particles can be employed. For the present invention, a Princeton Applied Research Model 155 Vibrating Sample Magnetometer, available from Princeton Applied Research Co., Princeton, N.J., is used to measure the coercivity of powder particle samples. The powder was mixed with a nonmagnetic polymer powder (90 percent magnetic powder:10 percent polymer by weight). The mixture was placed in a capillary tube, heated above the melting point of the polymer, and then allowed to cool to room temperature. The filled capillary tube was then placed in the sample holder of the magnetometer and a magnetic hysteresis loop of external field (in gauss units) versus induced magnetism (in EMU/gm) was plotted. During this measurement, the sample was exposed to an external field of 0 to 8000 gauss.

Figure 2:
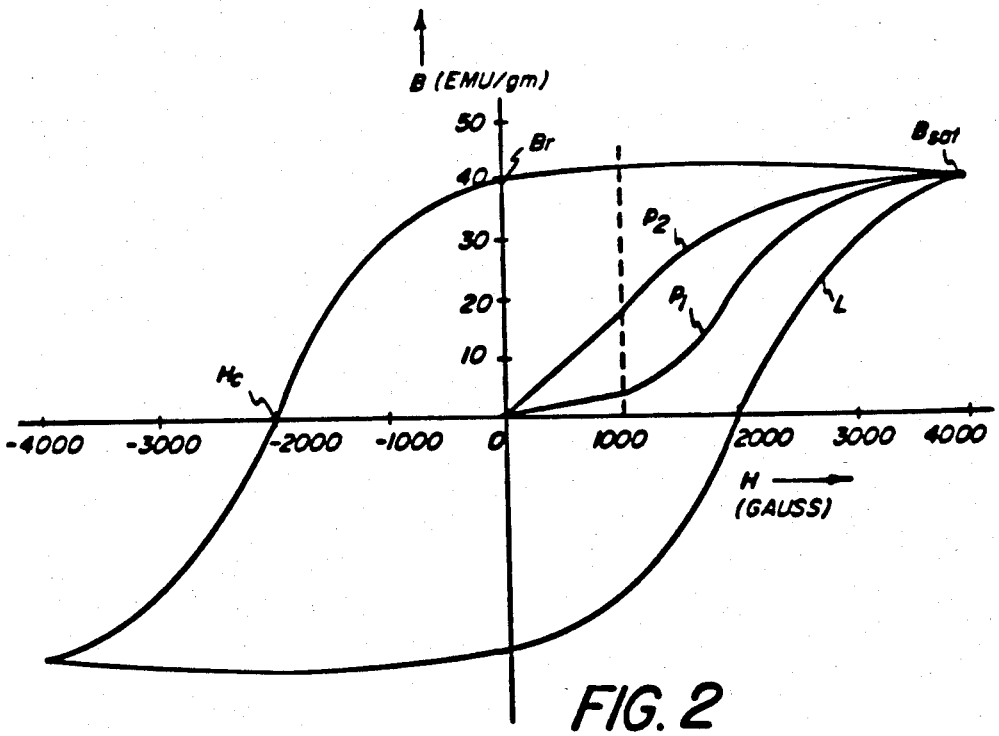
FIG. 2 is a graph illustrating the hysteresis behavior of "hard" magnetic carrier particles employed in the developer of the present invention.

FIG. 2 represents a hysteresis loop L for a typical "hard" magnetic powder when magnetically saturated. When a powdered material is magnetically saturated and immobilized in an applied magnetic field H of progressively increasing strength, a maximum, or saturated magnetic moment, Bsat, will be induced in the material. If the applied field H is further increased, the moment induced in the material will not increase any further. When the applied field, on the other hand, is progressively decreased through zero, reversed in applied polarity and thereafter increased again, the induced moment B of the powder will ultimately become zero and thus be on the threshold of reversal in induced polarity. The value of the applied field H necessary to bring about the decrease of the remanance, Br, to zero is called the coercivity, Hc, of the material. The carriers in the developers of the present invention contain magnetic material which exhibits a coercivity of at least 300 gauss when magnetically saturated, preferably a coercivity of at least 500 gauss and most preferably a coercivity of at least 1000 gauss. In this regard, while magnetic materials having coercivity levels of 2800 and 4100 gauss have been found useful, there appears to be no theoretical reason why higher coercivity levels would not be useful.

In addition to the minimum coercivity requirements of the magnetic material, the carrier particles in the developer of this invention exhibit an induced magnetic moment, B, of at least 20 EMU/gm, based on the weight of the carrier, when in an applied field of 1000 gauss. Preferably, B at a 1000 gauss for our carriers is at least 25 EMU/gm and most preferably is from about 30 to about 50 EMU/gm. To illustrate this point, reference is made to FIG. 2 depicting the magnetic parameters of two different binder-free carriers in which the induced magnetic moment of the magnetic material is the same as the induced moment for the carrier particles. In FIG. 2, the hysterisis loop at saturation, L, for the two different magnetic materials is the same for purposes of illustraton. Before being magnetized to saturation, these materials respond differently to magnetic fields as represented by their permeability curves, $P_1$ and $P_2$. For an applied field of 1000 gauss, material 1 will have a magnetic moment of about 5 EMU/gm, while material 2 will have a moment of about 15 EMU/gm. To increase the moment of either material at 1000 gauss applied field to the requisite level of at least 20 EMU/gm, one can premagnetize the material off-line to a field higher than 1000 gauss until the material acquires an hysterisis loop such that, when the material is reintroduced into a 1000-gauss field, it exhibits the requisite induced moment. In such offline treatment, which we will refer to as premagnetization, the material is preferably premagnetized to saturation, in which case either of the materials shown in FIG. 2 will exhibit an induced moment, B, of about 40 emu/gm. Preferably, such induced moment is at least 25 EMU/gm and most preferably in the range from about 30 EMU/gm to about 50 EMU/gm. In this regard, carrier particles with induced fields at 1000 gauss of from 50 to 100 EMU/gm are also useful.

The invention, as noted, entails the use of developer carriers in which coercivity and induced moment are important. The coercivity requirement relates to the ability of the developers to flow on a rotating-core applicator while the induced-moment requirement relates to the high rate at which the developer flows on such applicator. However, it is also important that there be sufficient magnetic attraction between the applicator and the carrier particles to hold the latter on the applicator shell during core rotation and thereby prevent the carrier from transferring to the image. Such attraction is provided also when the carrier particles have an induced moment of at least 20 EMU/gm when in an applied field of 1000 gauss.

Useful "hard" magnetic materials include ferrites and gamma ferric oxide. Preferably, the carrier particles are composed of ferrites, which are compounds of magnetic oxides containing iron as a major metallic component. For example, compounds of ferric oxide, $Fe_2O_3$, formed with basic metallic oxides having the general formula $MFeO_2$ or $MFe_2O_4$ where M represents a mono- or divalent metal and the iron is in the oxidation state of +3 are ferrites.

Ferrites also include those compounds of barium and/or strontium, such as $BaFe_{12}O_{19}$, $SrFe_{12}O_{19}$ and the magnetic ferrites having the formula $MO.6Fe_2O_3$, where M is barium, strontium or lead, as disclosed in U.S. Pat. No. 3,716,630 issued Feb. 13, 1973, to B. T. Shirt, the disclosure of which is incorporated herewith by reference. Strontium or barium ferrites are preferred.

The size of the "hard" magnetic carrier particles of the present invention can vary widely, but generally the average particle size is less than 100 micrometers. A preferred average carrier particle size is in the range from about 5 to 65 micrometers. In this regard, the inventors have determined that smaller particles within the ranges set forth can be employed with little or no carrier pick-up (i.e., transfer of carrier) onto the image being developed.

Carrier particles of the invention are employed in combination with toner particles to form a dry, two-component composition. In use, the toner particles are electrostatically attracted to the electrostatic charge pattern on an element while the carrier particles remain on the applicator shell. This is accomplished in part by intermixing the toner and carrier particles so that the carrier particles acquire a charge of one polarity and the toner particles acquire a charge of the opposite polarity. The charge polarity on the carrier is such that it will not be electrically attracted to the electrostatic charge pattern. The carrier particles are also prevented from depositing on the electrostatic charge pattern because the magnetic attraction exerted between the rotating core and the carrier particles exceeds the electrostatic attraction which may arise between the carrier particles and the charge image.

Tribocharging of toner and "hard" magnetic carrier is achieved by selecting materials that are so positioned in the triboelectric series to give the desired polarity and magnitude of charge when the toner and carrier particles intermix. If the carrier particles do not charge as desired with the toner employed, moreover, the carrier can be coated with a material which does. Such coating can be applied to either composite or binder-free particles as described herein. As previously noted, the charging level in the toner is preferably at least 5 $\mu$coul per gram of toner weight. The polarity of the toner charge, moreover, can be either positive or negative.

Various resin materials can be employed as a coating on the "hard" magnetic carrier particles. Examples include those described in U.S. Pat. Nos. 3,795,617 issued Mar. 5, 1974, to J. McCabe, 3,795,618 issued Mar. 5, 1974, to G. Kasper, and 4,076,857 to G. Kasper. The choice of resin will depend upon its triboelectric relationship with the intended toner. For use with toners which are desired to be positively charged, preferred resins for the carrier coating include fluorocarbon polymers such as poly(tetrafluoroethylene), poly(vinylidene fluoride) and poly(vinylidene fluoride-co-tetrafluoroethylene).

The carrier particles can be coated with a tribocharging resin by a variety of techniques such as solvent coating, spray application, plating, tumbling or melt coating. In melt coating, a dry mixture of "hard" magnetic particles with a small amount of powdered resin, e.g., 0.05 to 5.0 weight percent resin is formed, and the mixture heated to fuse the resin. Such a low concentration of resin will form a thin or discontinuous layer of resin on the carrier particles.

The developer is formed by mixing the particles with toner particles in a suitable concentration. Within developers of the invention, high concentrations of toner can be employed. Accordingly, the present developer preferably contains from about 70 to 99 weight percent carrier and about 30 to 1 weight percent toner based on the total weight of the developer; most preferably, such concentration is from about 75 to 99 weight percent carrier and from about 25 to 1 weight percent toner.

The toner component of the invention can be a powdered resin which is optionally colored. It normally is prepared by compounding a resin with a colorant, i.e., a dye or pigment, and any other desired addenda. If a developed image of low opacity is desired, no colorant need be added. Normally, however, a colorant is included and it can, in principle, be any of the materials mentioned in *Colour Index*, Vols. I and II, 2nd Edition. Carbon black is especially useful. The amount of colorant can vary over a wide range, e.g., from 3 to 20 weight percent of the polymer. Combinations of colorants may be used.

The mixture is heated and milled to disperse the colorant and other addenda in the resin. The mass is cooled, crushed into lumps and finely ground. The resulting toner particles range in diameter from 0.5 to 25 micrometers with an average size of 1 to 16 micrometers. Preferably, the average particle size ratio of carrier to toner lie within the range from about 15:1 to about 1:1. However, carrier-to-toner average particle size ratios of as high as 50:1 are also useful.

The toner resin can be selected from a wide variety of materials, including both natural and synthetic resins and modified natural resins, as disclosed, for example, in the patent to Kasper et al, U.S. Pat. No. 4,076,857 issued Feb. 28, 1978. Especially useful are the crosslinked polymers disclosed in the patent to Jadwin et al, U.S. Pat. No. 3,938,992 issued Feb. 17, 1976, and the patent to Sadamatsu et al, U.S. Pat. No. 3,941,898 issued Mar. 2, 1976. The crosslinked or noncrosslinked copolymers of styrene or lower alkyl styrenes with acrylic monomers such as alkyl acrylates or methacrylates are particularly useful. Also useful are condensation polymers such as polyesters.

The shape of the toner can be irregular, as in the case of ground toners, or spherical. Spherical particles are obtained by spray-drying a solution of the toner resin in a solvent. Alternatively, spherical particles can be prepared by the polymer bead swelling technique disclosed in European Pat. No. 3905 published Sept. 5, 1979, to J. Ugelstad.

The toner can also contain minor components such as charge control agents and antiblocking agents. Especially useful charge control agents are disclosed in U.S. Pat. No. 3,893,935 and British Pat. No. 1,501,065. Quaternary ammonium salt charge agents as disclosed in *Research Disclosure*, No. 21030, Volume 210, October, 1981 (published by Industrial Opportunities Ltd., Homewell, Havant, Hampshire, PO9 1EF, United Kingdom), are also useful.

As noted previously, the carriers employed in the present invention invariably exhibit a high remanance, $B_R$. For example, the magnetic materials represented by the saturation hysterisis loop, L, in FIG. 2 exhibit a remanance (i.e., a zero-field moment) of about 39 EMU/gm. As a result, carriers made up of these materials, behave like wet sand because of the magnetic attraction exerted between carrier particles. Replenishment of the present developer with fresh toner, therefore, presents some difficulty. According to another preferred embodiment of the invention, developer replenishment is enhanced when the toner is selected so that its charge, as defined below, is at least 5 microcoulombs per gram of toner. Charging levels from about 10 to 30 microcoulombs per gram toner are preferred, while charging levels up to about 150 microcoulombs per gram of toner are also useful. At such charging levels, the electrostatic force of attraction between toner particles and carrier particles is sufficient to disrupt the magnetic attractive forces between carrier particles, thus facilitating replenishment. How these charging levels are achieved is described below.

The charge of the toner employed in the present developers is determined by plating the toner by electrical bias onto the electrically insulating layer of a test element. This element is composed of, in sequence, a film support, an electrically conducting (i.e., ground) layer and the insulating layer. The amount of plating is controlled to provide a mid-range reflection optical density (OD). For purposes of the present invention, toner was plated to an OD about 0.3. The test element containing the plated toner is connected via the ground layer to an electrometer. The plated toner is then rapidly removed in a current of forced air, causing a flow of current to register in the electrometer as a charge, in microcoulombs. The registered charge is divided by the weight of the plated toner to obtain the toner charge. It will be appreciated, in this regard, that the carrier will bear about the same charge as, but opposite in polarity to, that of the toner.

In the method of the present invention, an electrostatic image is brought into contact with a magnetic brush comprising a rotating-magnetic core, an outer nonmagnetic shell and the two-component, dry developer described above. The electrostatic image so developed can be formed by a number of methods such as by imagewise photodecay of a photoreceptor, or imagewise application of a charge pattern on the surface of a dielectric recording element. When photoreceptors are employed, such as in high-speed electrophotographic copy devices, the use of halftone screening to modify an electrostatic image is particularly desirable, the combination of screening with development in accordance with the method of the present invention producing high-quality images exhibiting high Dmax and excellent tonal range. Representative screening methods including those employing photoreceptors with integral halftone screens are disclosed in copending U.S. patent application Ser. No. 133,077 filed Mar. 24, 1980, now U.S. Pat. No. 4,385,823 issued May 31, 1984, in the names of G. E. Kasper et al.

The developers and the magnetic brush according to the present invention are capable of delivering toner to a charge image at high rates and hence are particularly suited to high-volume electrophotographic copying applications. High-volume copying signifies a capability of producing completely developed images on a photoreceptor passing by the magnetic brush at a linear rate of 25 cm per second and greater; that is, for a given set of brush conditions, the developers of the present invention will produce toned images of a given optical density at higher photoreceptor speeds compared with developers in which the carrier does not meet the minimum induced moment requirement or which contains magnetic material of less than 300-gauss coercivity. Furthermore, well-developed images have been achieved with the developers of this invention on photoreceptors traveling at 75 cm per second.

The following examples are provided to aid in the practice of the present invention.

In the first example, carriers exhibiting hard magnetic properties as defined herein were evaluated for their flow characteristics on a rotating-core magnetic applicator similar to the applicator shown in FIG. 1. Toner was not employed with the carrier during flow evaluations.

The magnetic applicator included a 5.1-cm outside diameter, nonmagnetic stainless steel shell. A core containing twelve alternating pole magnets was enclosed in the shell. Each of the magnets was 1000 gauss in strength and 3 inches (7.62 centimeters) in axial length. The tests were made while rotating the magnets counterclockwise at 1000 and 2000 rpm. Carrier was distributed on the shell from a feed hopper and traveled clockwise around the shell. A trim skive was set to allow a nap thickness of 0.05 cm. Carrier was removed from the brush by means of a fixed skive 7.6 cm downstream from the feed hopper and was caught in a hopper. First the magnets were allowed to rotate while being fed carrier. After the shell was uniformly covered with carrier, the motor drive to the magnetic core was stopped. The catch hopper was emptied, weighed and replaced next to the shell. The magnetic core was rotated again for a period of 15 seconds, and then the catch hopper was weighed with the carrier which had been removed from the brush. The weight of the hopper was subtracted from the total and the net amount was determined in grams per minute.

COMPARATIVE EXAMPLE 1

Binder-free carrier particles having the characteristics listed in Table 1 below were evaluated for their ability to flow past restrictions on a rotating-core magnetic applicator and for their rate of flow on the applicator.

TABLE 1

| Carrier | Type | Particle Size Range (microns) | Coercivity at Saturation (gauss) | Induced Moment at 1000 Gauss (EMU/gm) |
|---|---|---|---|---|
| A | strontium ferrite | 53–62 | 300 | 16.4 |
| B | strontium ferrite | 53–62 | 500 | 18.6 |
| C | strontium ferrite | 53–62 | 1500 | 14.5 |
| D | strontium ferrite | 53–62 | 1500 | 14.5 |
| E | strontium ferrite | 53–62 | 2850 | 13.2 |
| F | strontium ferrite | 53–62 | 2730 | 13.8 |
| G | strontium | 53–62 | 1360 | 13.9 |

TABLE 1-continued

| Carrier | Type | Particle Size Range (microns) | Coercivity at Saturation (gauss) | Induced Moment at 1000 Gauss (EMU/gm) |
|---|---|---|---|---|
| H | ferrite strontium ferrite | 53–62 | 2800 | 16.4 |
| I | ferrite strontium ferrite | 53–62 | 4100 | 14.1 |

Each of the carriers of Table 1 flowed unimpeded on the rotating-core applicator. In comparison, however, binder-free carriers having a coercivity below 100 gauss accumulated undesirably on the upstream side of the nap thickness-regulating skive.

The flow measurements for each of the carriers were determined in the manner set forth above and the flow values recorded are shown in Table 2. The rates were determined for a core speed of 2000 rpm.

TABLE 2

| Carrier | Flow Rate (grams/minute) |
|---|---|
| A | 374.8 |
| B | 365.2 |
| C | 343.2 |
| D | 318.4 |
| E | 302 |
| F | 286.4 |
| G | 298.8 |
| H | 354 |
| I | 298.8 |

The results of the above flow-rate determinations indicate that carriers A-I travel unimpeded on rotating, magnetic-core applicators, but that their rates of flow were slower in comparison with carriers employed in the developers of the present invention as shown in Example 2.

EXAMPLE 2

This illustrates carriers for use in developers of the invention which have been permanently magnetized in an external field so as to increase their induced moment at 1000 gauss to above 20 EMU/gm.

Unmagnetized samples of carrier powders A, B, H and I were subjected to the following off-line pretreatment:

First, the loose powders were placed in glass vials measuring $1\frac{1}{4}$ inches in diameter and $4\frac{1}{2}$ inches in length. The loaded vials were placed in a 96149 magnetizing coil designed by RFL Industries of Boonton, N.J. This magnetic coil had a field range of 6,000 to 10,000 gauss. Power to activate the magnetizing fixture was supplied by a Model 595 Magnetreater/Charger also obtained from RFL Industries. Each sample was given a single pulse of charge sufficient to magnetize the ferrites to saturation.

Table 3 below lists the induced moments of the ferrites at a 1000-gauss external field before and after magnetic saturation and the corresponding carrier flow rates at 1000 rpm and 2000 rpm rotation of the core. The induced moments were increased after magnetic saturation. This increased magnetic moment increases the attraction between the ferrite carrier particles and the magnetic brush shell. As a result, the flow rate of the particles is significantly increased, as shown, after saturation magnetization.

TABLE 3

| Carrier | | Induced Moment at 1000 Gauss (EMU/gm) | Flow Rate 1000 rpm (gms/min) | Flow Rate 2000 rpm (gms/min) |
|---|---|---|---|---|
| A | untreated | 18.3 | — | *317 |
| | saturated | 23.4 | — | 346 |
| B | untreated | 18.6 | — | *338 |
| | saturated | 27.3 | — | 358 |
| H | untreated | 16.4 | 199.2 | 354 |
| | saturated | 31.79 | 340.8 | 628.8 |
| I | untreated | 14.1 | 180.0 | 298.8 |
| | saturated | 30.06 | 313.2 | 585 |

*These values differed slightly from the corresponding 2000-rpm flow rates of carriers A and B in comparative Example 1, as the samples A and B contained a distribution of larger-sized particles, causing a slower flow rate in Example 2.

EXAMPLE 3

This example illustrates a developer of the present invention.

Binder-free strontium ferrite carrier particles having an induced magnetic moment at 1000 gauss of 30.9 EMU/gm and a coercivity of 3500 gauss were coated with 1.0 part per hundred Kynar 301 fluorocarbon polymer (Pennwalt Chemical Company, King of Prussia, Pa.) which enabled the carrier to charge toner positively. The toner charge, as determined herein, ranged from 11.4 to 11.6 microcoulombs per gram of toner.

The toner particles comprised a pigmented styrene acrylic copolymer. The toner particles ranged in particle size from 5 to 20 micrometers.

The developer was formulated by mixing the carrier and toner. The concentration of toner was 13% by weight of the total developer.

EXAMPLE 4

This illustrates the method of the present invention using the developer of Example 3 on a rotating-core magnetic applicator as described in connection with flow-rate determinations.

After shaking, 1500 g of the developer were fed to the applicator shell. The set points for resulting brush were a 0.05-cm gap between the chargebearing surface and developer, and a nap thickness of 0.06 cm. The core of the magnetic applicator was rotated at 1250 revolutions per minute in a direction counter to the direction in which the photoreceptor moved. The shell of the applicator was rotated at 30 revolutions per minute.

The photoconductive element employed in the example was a negatively charged reusable photoconductive film. Electrostatic images were formed thereon by uniformly charging the element to −500 volts and exposing the charged element to an original. The resulting charge image ranged from −50 volts to −350 volts and was developed by passing the element over the magnetic brush at a speed of 28.9 cm/sec in the direction of developer flow. The brush was electrically biased to −115 volts.

After development, the toner image was electrostatically transferred to a paper receiver and thereon fixed by roller fusion at 149°–177° C.

High-quality images were obtained from the standpoint of development completion and uniformity. Development in this manner has also been successful at photoreceptor speeds up to about 75 cm/sec.

"Electrography" and "electrographic" as used herein are broad terms which include image-forming processes involving the development of an electrostatic charge pattern formed on a surface with or without light exposure, and thus include electrophotography and other processes.

Although the invention has been described in considerable detail with particular reference to certain preferred embodiments thereof, variations and modifications can be effected within the spirit and scope of the invention.

I claim:

1. An electrographic, two-component dry developer composition comprising charged toner particles and oppositely charged carrier particles which (a) comprise a hard magnetic material exhibiting a coercivity of at least 300 gauss when magnetically saturated and (b) exhibit an induced magnetic moment of at least 20 EMU/gm of carrier when in an applied field of 1000 gauss.

2. The composition of claim 1 wherein the induced magnetic moment of said carrier particles is at least 25 EMU/gm.

3. The composition of claim 1 wherein the induced magnetic moment of said carrier particles is from about 30 to about 50 EMU/gm.

4. The composition of claim 1, 2 or 3 wherein said magnetic material is pretreated to magnetic saturation.

5. The composition of claim 2 wherein the coercivity of said magnetic material is at least 500 gauss.

6. The composition of claim 3 wherein the coercivity of said magnetic material is at least 1000 gauss.

7. The composition of claim 1, 2, or 5 wherein the charge of said toner is at least 5 microcoulombs per gram of toner.

8. The composition of claim 7 wherein said hard magnetic material is a strontium or barium ferrite.

9. An electrographic, two-component dry developer composition comprising charged toner particles and oppositely charged binder-free carrier particles which (a) comprise a hard magnetic material exhibiting a coercivity of at least 300 gauss when magnetically saturated and (b) exhibit an induced magnetic moment of at least 20 EMU/gm of carrier when in an applied field of 1000 gauss.

10. The composition of claim 9 wherein the induced magnetic moment of said carrier particles is at least 25 EMU/gm.

11. The composition of claim 9 wherein the induced magnetic moment of said carrier particles is from about 30 to about 50 EMU/gm.

12. The composition of claim 9, 10 or 11 wherein said magnetic material is pretreated to magnetic saturation.

13. The composition of claim 10 wherein the coercivity of said magnetic material is at least 500 gauss.

14. The composition of claim 11 wherein the coercivity of said magnetic material is at least 1000 gauss.

15. The composition of claim 9, 10, or 13 wherein the charge of said toner is at least 5 microcoulombs per gram of toner.

16. The composition of claim 15 wherein said hard magnetic material is a strontium or barium ferrite.

17. An electrographic, two-component dry developer composition comprising charged toner particles and oppositely charged composite carrier particles which (a) comprise a binder and a plurality of magnetic particles dispersed in said binder composed of a hard magnetic material exhibiting a coercivity of at least 300 gauss when magnetically saturated and (b) exhibit an induced magnetic moment of at least 20 EMU/gm of carrier when in an applied field of 1000 gauss.

18. The composition of claim 17 wherein the induced magnetic moment of said carrier particles is at least 25 EMU/gm.

19. The composition of claim 17 wherein the induced magnetic moment of said carrier particles is from about 30 to about 50 EMU/gm.

20. The composition of claim 17, 18 or 19 wherein said magnetic material is pretreated to magnetic saturation.

21. The composition of claim 18 wherein the coercivity of said magnetic material is at least 500 gauss.

22. The composition of claim 19 wherein the coercivity of said magnetic material is at least 1000 gauss.

23. The composition of claim 17, 18, or 21 wherein the charge of said toner is at least 5 microcoulombs per gram of toner.

24. The composition of claim 23 wherein said hard magnetic material is a strontium or barium ferrite.

25. The composition of claim 5, 13 or 21 wherein the average size of said carrier particles is in the range from about 5 to 65 micrometers.

26. The composion of claim 25 wherein the ratio of the average particle size of said carrier particles to the average particle size of said toner particles is in the range from about 1:1 to about 15:1.

27. The composion of claim 25 wherein the concentration of said toner is in the range from about 1 to about 25 percent, by weight of said developer composition.

28. The composition of claim 25 wherein said toner particles are spherical.

29. A method for developing an electrostatic image comprising contacting the image with at least one magnetic brush comprising (a) a rotating magnetic core of a preselected magnetic field strength, (b) an outer nonmagnetic shell and (c) an electrographic, two-component dry developer composition comprising charged toner particles and oppositely charged carrier particles which (i) comprise a hard magnetic material exhibiting a coercivity of at least 300 gauss when magnetically saturated and (ii) exhibit an induced magnetic moment of at least 20 EMU/gm when in an externally applied field of 1000 gauss, and which magnetic moment is sufficient to prevent said carrier from transferring to said electrostatic image.

30. The method of claim 29 wherein said rotating, magnetic core exhibits a magnetic field strength of at least 450 gauss.

31. The method of claim 30 wherein the field strength of said rotating core is in the range from about 800 to about 1600 gauss.

32. The method of claim 29 wherein said carrier particles are binder-free.

33. The method of claim 29 wherein said carrier particles are composite particles comprising a binder and a plurality of magnetic particles composed of said magnetic material dispersed in said binder.

34. The method of claim 32 or 33 wherein said magnetic material is a strontium or barium ferrite.

35. The method of claim 32 or 33 wherein the coercivity of said magnetic material is at least 500 gauss.

36. The method of claim 32 or 33 wherein the coercivity of said magnetic material is at least about 1000 gauss.

37. The method of claim 35 wherein the induced magnetic moment of said carrier particles is at least 25 EMU/gm.

38. The method of claim 35 wherein the induced magnetic moment of said carrier particles is from about 30 to about 50 EMU/gm.

39. The method of claim 38 wherein said magnetic material is pretreated to magnetic saturation.

40. The method of claim 38 wherein the charge of said toner is at least 5 microcoulombs per gram of toner.

41. A method for developing an electrostatic image comprising contacting the image with at least one magnetic brush comprising (a) a rotating magnetic core of a preselected magnetic field strength, (b) an outer non-magnetic shell and (c) an electrographic, two-component dry developer composition comprising charged toner particles and oppositely charged binder-free hard ferrite carrier particles exhibiting (i) a coercivity of at least 500 gauss when magnetically saturated sufficient to cause said developer to flow circumferentially on said shell in a direction opposite the direction of magnetic core rotation and (ii) an induced magnetic moment of at least 25 EMU/gm when in an externally applied field of 1000 gauss, and which magnetic moment is sufficient to prevent said carrier from transferring to said electrostatic image, said toner and carrier particles in said developer having a triboelectric force of attraction which is greater than the magnetic force of attraction between carrier particles in said developer.

42. A method as in claim 41 wherein the average size of said carrier particles is from about 5 to about 65 micrometers and the ratio of the average particle size for said carrier particles to the average particle size of said toner particles is from about 1:1 to about 15:1.

43. A method for developing an electrostatic image comprising contacting the image with at least one magnetic brush comprising (a) a rotating magnetic core which rotates at a speed from about 1000 to about 3000 revolutions per minute and has a preselected magnetic field strength (b) an outer non-magnetic shell and (c) an electrographic, two-component dry developer composition comprising charged toner particles and oppositely charged carrier particles which (i) comprise a hard magnetic material exhibiting a coercivity of at least 300 gauss when magnetically saturated and (ii) exhibit an induced magnetic moment of at least 20 EMU/gm when in an externally applied field of 1000 gauss, and which magnetic moment is sufficient to prevent said carrier from transferring to said electrostatic image.

* * * * *

UNITED STATES PATENT AND TRADEMARK OFFICE

CERTIFICATE OF CORRECTION

PATENT NO. : 4,546,060

DATED : October 8, 1985

INVENTOR(S) : Edward T. Miskinis and Thomas A. Jadwin

It is certified that error appears in the above-identified patent and that said Letters Patent are hereby corrected as shown below:

At column 1, line 6, after the title of the invention and before the first line of the specification, insert --This is a continuation-in-part of Application Serial No. 440,146; filed November 8, 1982.--

Signed and Sealed this

Thirty-first Day of March, 1987

*Attest:*

DONALD J. QUIGG

*Attesting Officer*

*Commissioner of Patents and Trademarks*